US006397869B1

(12) United States Patent
Jennings

(10) Patent No.: US 6,397,869 B1
(45) Date of Patent: Jun. 4, 2002

(54) PORTABLE CAMPING TENT STRUCTURE WITH BUILT-IN OVERHEAD ELECTRIC FAN AND POWER SOURCE

(76) Inventor: Harry G. Jennings, 304 W. Greenwood, Jacksonville, IL (US) 62650

( * ) Notice: Subject to any disclaimer, the term of this patent is extended or adjusted under 35 U.S.C. 154(b) by 0 days.

(21) Appl. No.: 09/754,758

(22) Filed: Jan. 4, 2001

(51) Int. Cl.[7] ..... E04H 15/14

(52) U.S. Cl. ..... 135/93; 135/94; 135/91; 135/910; 135/120.1; 52/2.11

(58) Field of Search ..... 135/94, 91, 93, 135/910, 120.1; 52/2.11

(56) References Cited

U.S. PATENT DOCUMENTS 5,331,991 A * 7/1994 Nilsson ..... 135/91
5,970,661 A * 10/1999 Bishop et al. ..... 135/93
6,266,927 B1 * 7/2001 Leslie ..... 52/2.17

* cited by examiner

*Primary Examiner*—Beth A. Stephan
*Assistant Examiner*—Chi Q. Nguyen

(57) ABSTRACT

An electric fan with mounted light (6) mounted overhead within a square dome camping tent (1). The fan/light unit is supported by a series of fiberglass poles (12), and pole footings (10). The fan/light unit is powered by a portable power supply and control unit (7) which contains power switches (23), an updraft/downdraft switch (24), an accessory plug (25), and a charger plug (27).

1 Claim, 5 Drawing Sheets

PORTABLE CAMPING TENT STRUCTURE WITH BUILT-IN OVERHEAD ELECTRIC FAN AND POWER SOURCE

CROSS-REFERENCE TO RELATED APPLICATIONS

Not Applicable.

BACKGROUND—Field of Invention

This invention relates generally to electric fans, and more specifically, to a portable fan which is designed to be suspended overhead in a camping tent, with a compact portable power supply.

BACKGROUND—Description of Prior Art

When camping, heat and humidity in tents are common problems. Portable battery operated fans are often used to move air in tents. However, the common portable fan moves little air in a tent and thus fails to cool the occupants. Also, to remove excess humidity from a tent inside air must be exchanged with outside air. Common portable fans fail to exchange enough air to remove excess humidity.

There are other disadvantages of common portable fans for camping. Tent space is limited and cumbersome fans can take up precious room. A fan on a tent floor also needs to be free of obstacles in order to move sufficient air, again taking up more room. These fans can be easily knocked over rendering them useless. Also, common portable fans become ineffective in rainy weather when tent doors and windows must be closed.

SUMMARY

In accordance with the present invention a portable overhead electric fan for a camping tent comprises a shrouded electric fan, supporting brackets, and a proper power source.

Objects and Advantages

Several objects and advantages of the present invention are:

(a) to cool a camping tent by moving large volumes of air within the tent as well as removing the hotter air that normally remains trapped at the top of the tent;

(b) to remove excess humidity from a camping tent by rapidly exchanging the stale air within the tent with fresh air from outside the tent;

(c) to provide tent campers with a portable fan that remains efficient and effective even in rainy weather.

(d) to provide tent campers with a powerful and efficient portable fan without taking up much room within the tent.

(e) to provide campers with a portable power supply readily adaptable for accessories such as additional lighting, air pumps, etc.

Further objects and advantages are to provide a portable fan that is easy and convenient to use. The fan is also easy to set up inside the tent and takes up little room. Still further objects and advantages will become apparent from a consideration of the ensuing description and drawings.

DRAWING FIGURES

In the drawings, there are eight figures with individual numbered items within each figure.

Figure 1:
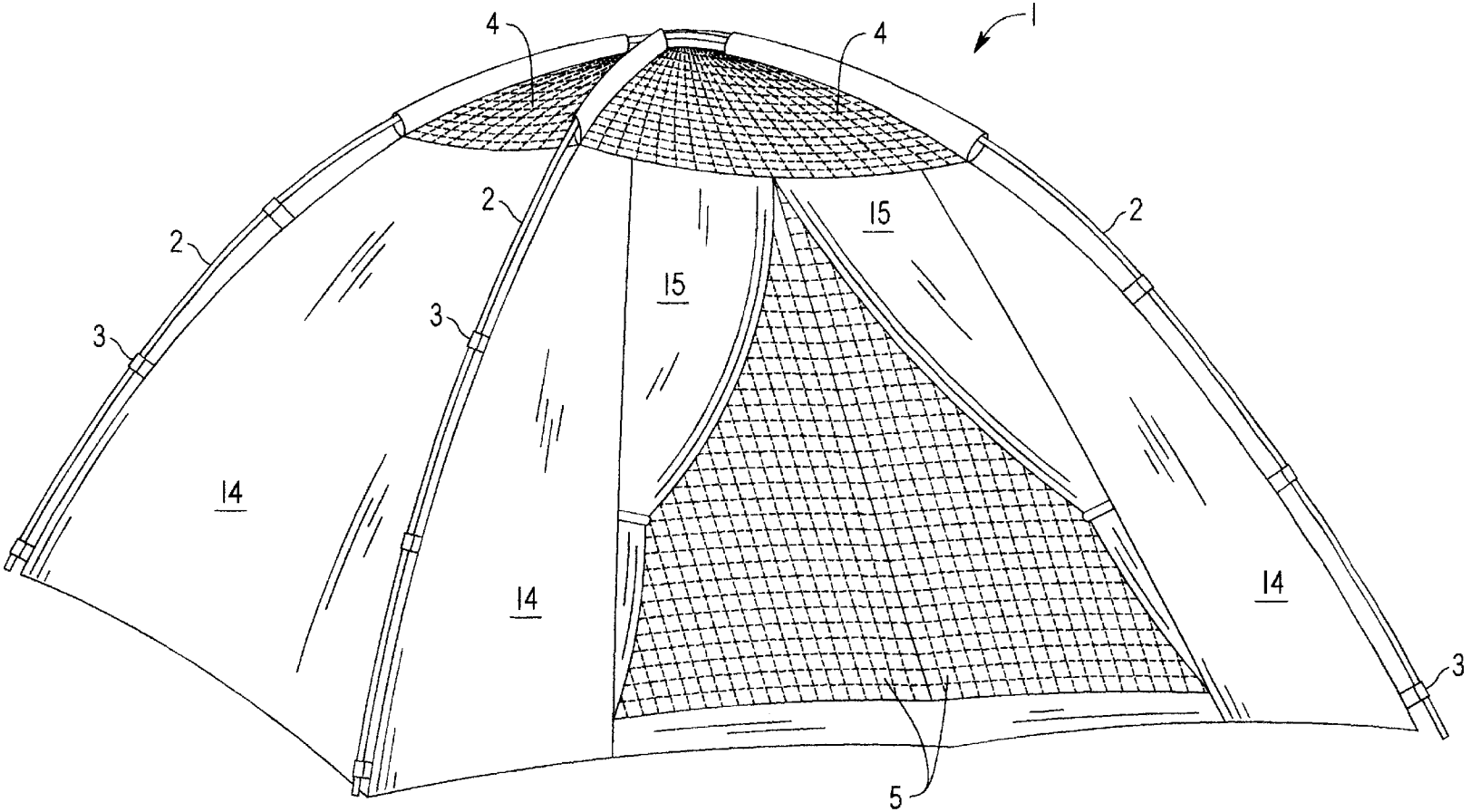
FIG. 1 (PRIOR ART)
FIG. 1 shows the existing tent unit (Item 1), along with the existing fiberglass poles (Item 2), existing clips for attachment (Item 3), existing upper mesh openings (Item 4), existing mesh door openings (Item 5), existing tent wall (Item 14), and existing tent doors (Item 15).

| Reference Numerals In Drawings | |
|---|---|
| 1 Existing tent unit | 2 Existing Fiberglass Poles |
| 3 Existing clips for attachment | 4 Upper mesh openings |
| 5 Mesh door opening | 6 Fan and light unit |
| 7 Power supply and control unit | 8 Wiring/Power cord |
| 9 Wiring attachment | 10 Inner fiberglass pole footing |
| 11 Fan attachments | 12 Inner fiberglass pole |
| 13 Inner pole attachment ties | 14 Tent wall |
| 15 Tent door | 16 Tent floor |
| 17 Velcro hook | 18 Velcro loop |
| 19 Footing receiver portion | 20 Reinforced portion of tent wall |
| 21 Rain Tarp | 22 Air flow arrows |
| 23 Fan/Light power switch | 24 UD/DD reversible switch |
| 25 Accessory Plug | 26 Charger plug |
| 27 In-line fuse | |

DESCRIPTIONS—FIGS. 1, 2, AND 3—PREFERRED EMBODIMENT

Figure 2:
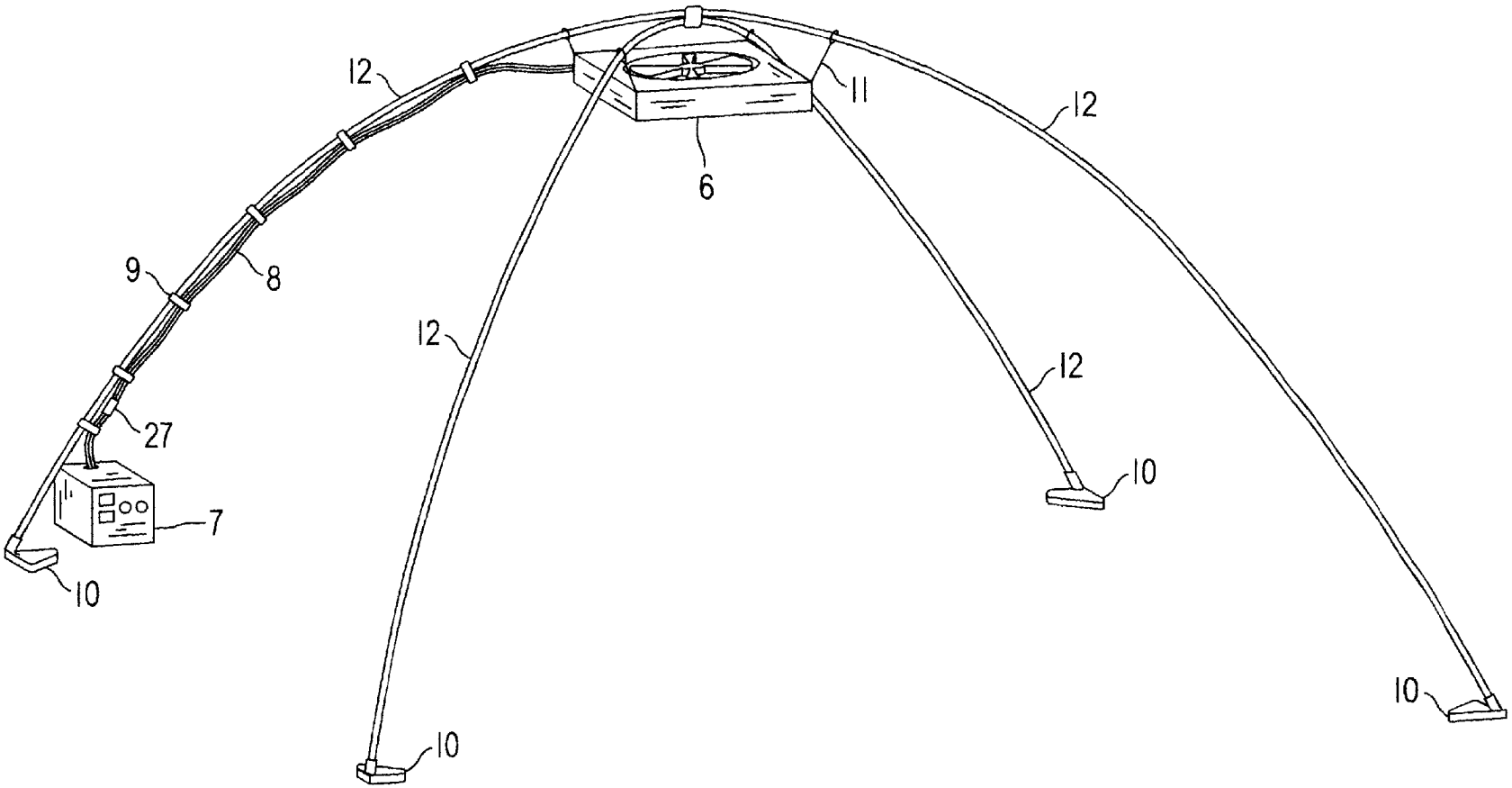
FIG. 2 shows a mock-up of the interior fan/light unit (Item 6), power supply and control unit (Item 7), wire attachments (Item 8) with in-line fuse (Item 27), the supporting inner fiberglass poles (Item 12), with the fan attachments (Unit 11), wiring attachments (Unit 9), and inner pole footings (Item 10).
Figure 3:
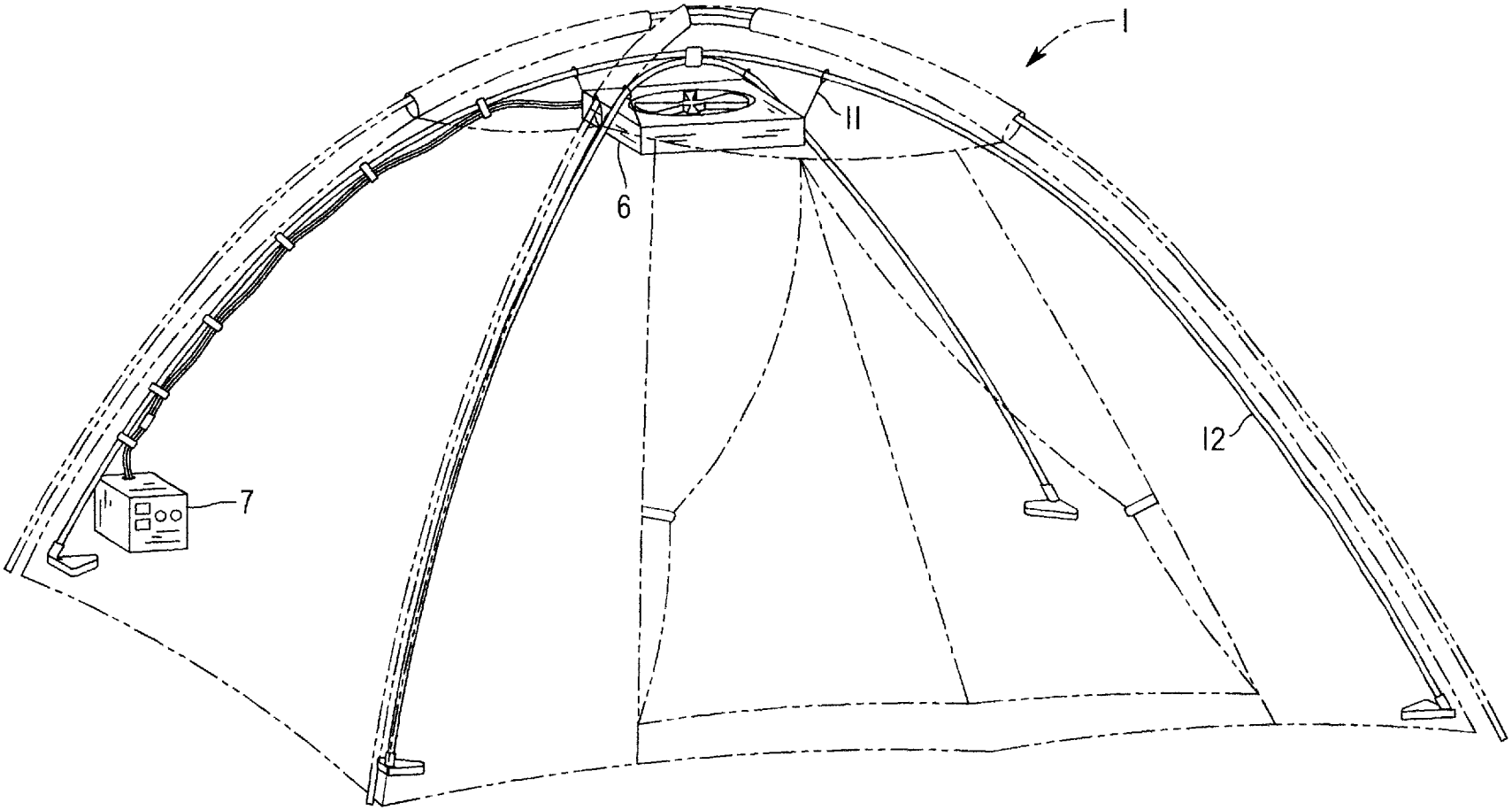
FIG. 3 shows a transparent view of FIG. 1 with the mock-up of FIG. 2 visible inside.

A preferred embodiment of the present invention is illustrated in FIGS. 1, 2, and 3. As seen in these figures a fan and light unit 6 can be neatly and securely mounted inside of a standard square dome camping tent. The fan and light unit is easily powered by a portable power supply and control unit 7. With this invention it becomes easy and convenient to cool a camping tent and remove the excess humidity. The power supply and control unit 7 can also be used to power other items that are commonly used while camping. The power supply and control unit 7 can be easily recharged by plugging it directly into a common 110V power source, through the charging system of an automobile, or adapted to be recharged by solar power.

Figure 4:
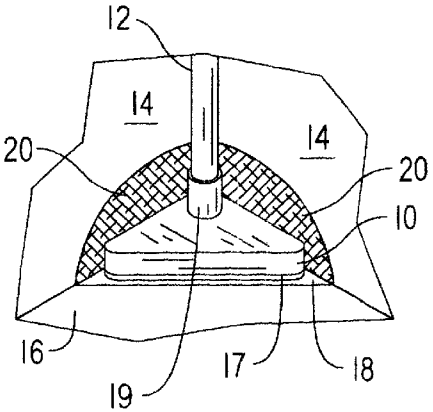
FIG. 4 is a close-up of the inner pole footings (Item 10). Shown in FIG. 4 is the inner pole footing as a whole (Item 10), the footing receiver portion (Item 19), the inner fiberglass pole (Item 12), the velcro hook attachment (Item 17), the velcro loop attachment (Item 18), the tent floor (Item 16), the tent wall (Item 14), and a reinforced portion of the tent wall (Item 20).

FIG. 4—Additional Embodiments

Additional embodiments are shown in FIG. 4. In this figure a detail drawing of the inner pole footing 10 is shown. A footing for the pole is needed to keep the interior pole 12 from damaging the tent. Extra tent material 20 is added in the tent corner for additional support.

Figure 5:
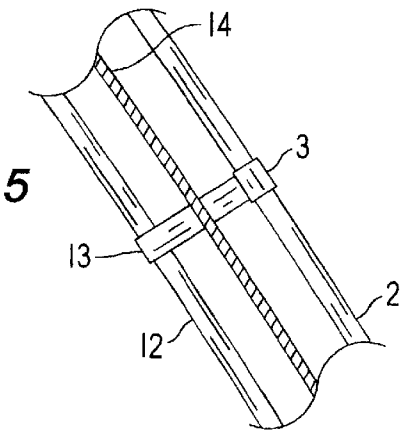
FIG. 5 shows how the inner fiberglass poles attach to the interior of the tent and correspond with the existing exterior fiberglass pole attachments. Shown in FIG. 5 is the tent wall (Item 14), the exterior poles (Item 2), the exterior attachment clips (Item 3), the interior poles (Item 12), and the interior attachment ties (Item 13).

FIG. 5—Additional Embodiments

Additional embodiments are shown in FIG. 5. In this figure a detailed drawing of the interior poles 12 and exterior poles 2 are shown. The exterior poles 2 are the main structure of a dome tent. Clip 3 are used t o attach the tent to the exterior poles 2. The interior poles 12 attach close and snug to the interior of the tent (gap shown for clarity) using a nylon tie 13. The interior pole ties 13 are placed directly in line with the exterior pole clips 3 for added support.

Figure 6:
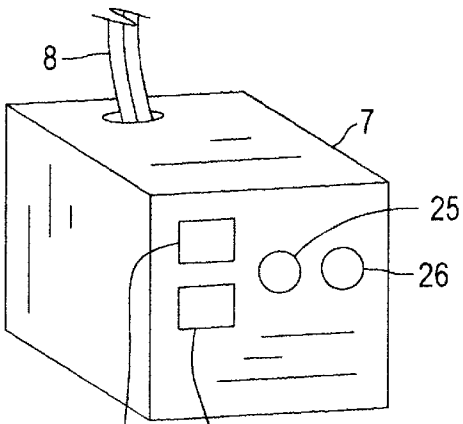
FIG. 6 shows the power supply and control unit (Item 7). Shown in FIG. 6 is the power supply and control unit (Item 7), wiring (Item 8), the fan speed and light power switch (Item 23), the updraft/downdraft reversible switch (Item 24), the accessory plug (Item 25), and the charger plug for the built-in trickle charger (Item 26).

FIG. 6—Additional Embodiments

Additional embodiments are shown in FIG. 6. In this figure a detailed drawing of the exterior of the power supply and control unit 7 is shown. The power supply and control unit 7 contains a deep-cycle batteries, trickle charger, and switches and adapters. Mounted on the exterior of the power supply and control unit is a power switch for the light and fan 23. To best control the fan speeds without wasting power a Pulse Width Modulation switch is used. There is also a reversible switch for the fan 24. This allows the use of either updraft or downdraft mode. An accessory plug 25 can be used to power common 12V items such as air pumps, small vacuums, lights, etc. For more convenient charging there is a charger plug 26 built into the power supply and control unit 7. With the addition of an inverter the power supply and control unit can also power common household 110V items such at power tools, TVs, radios, etc. The power supply and control unit 7 can be recharged by a common 110V power source, by an automotive 12V system, or with a simple portable solar panel without any additional chargers.

Figure 8:
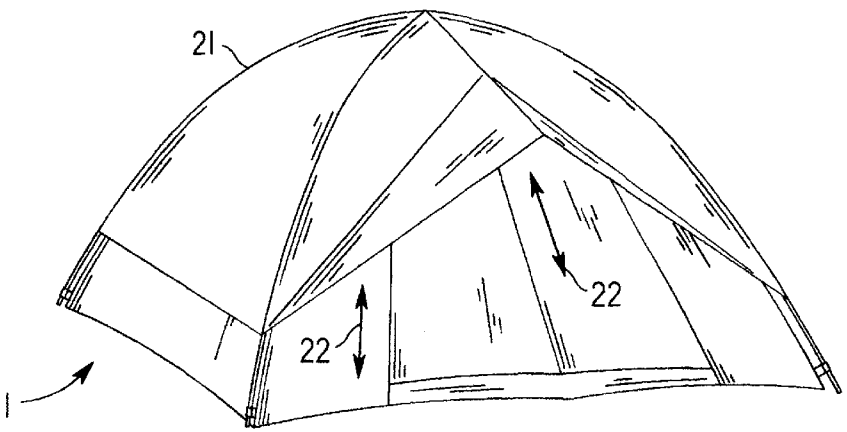
FIG. 8 shows the existing tent unit (Item 1) and the air flow (Item 22) with the rain tarp in place (Item 21).
Figure 7:
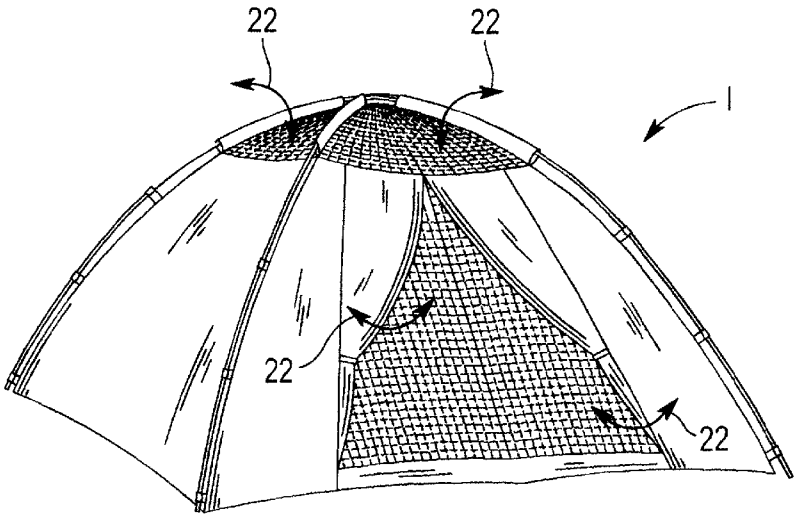
FIG. 7 shows the existing tent unit (Item 1) and the air flow (Item 22) without the rain tarp in place.

FIGS. 7 and 8—Additional Embodiments

FIGS. 7 and 8 show the air flow 22 through the tent both with the rain tarp on and off. Since the bottoms of the doors 15 do not securely attach to the tent air can freely flow out the bottom of the door with the door shut and the fan 6 in downdraft mode. This is a great advantage as the fan can still be used with the tent seemingly close up. This allows the fan to still be ran during rainy weather or times of heavy dew. This is a great aid in removing excess humidity caused by these conditions.

Advantages

From the description above, a number of advantages of my overhead fan suspended whiting a camping tent become evident:

(a) A suspended overhead electric fan within a camping tent cools much more easily then other types of fans.

(b) This type of fan also removes excess humidity from the tent which other fans fail to do.

(c) This type of fan can also be used, and remains effective, in the rain or other such conditions with the tent doors mush remain closed. This also aids in privacy as the fan can be operated when the tent doors closed.

(d) With the attached overhead light, lighting is improved. There is also no longer a need to search for a flashlight.

(e) The fan/light unit is compact and takes up very little space. This is important in a small confined tent.

(f) With the compact and portable power supply and control unit there is no longer a need for electricity. Camping sites with electricity are often more crowded and less scenic when compared to camping sites without electrical power. With the power supply and control unit everything is compact, portable, and self-contained.

(g) The power supply and control unit can also be used to power other 12V items. There are many common camping items, such at an air mattress pump, tire air pump, lights, etc. that can be easily powered with this compact unit. With the use of an inverter the unit can also power 110V items such as a can-opener, radio, TV, etc.

Operation—FIGS. 1, 2, and 3

To use this fan/light unit it must be set up inside of an appropriate dome tent. The tent is set up in a normal manner with the exterior fiberglass poles set up in a crisscross fashion supporting the weight of the tent.

With the tent properly set up the interior pole footings 10 are attached to each corner of the tent with a velcro hook/loop system. With the pole footings in place the interior fiberglass poles 12 are placed into the footing receiver portion 19 of the inner pole footings. The inner fiberglass poles are then pushed inward and the opposite end of the pole is placed into the corresponding pole footing. With the inner poles in place they are secured to the interior of the tent using ties 13.

Once the interior structure is in place the fan/light unit is secured to the poles with the fan attachments 11 on each corner of the fan. An additional fan attachment attaches to the top center of the tent which is secured to the exterior poles. This last attachment is not for support, but as a safety measure.

With the fan/light unit in place put the power supply and control unit 7 in a corner of the tent and run the power cord 8 up the interior pole and attach it to the fan/light unit and the power supply and control unit. Secure the cord to the interior pole using the wiring attachments 9.

The fan and light are operated with the appropriate switches on the power supply and control unit. To power 12V accessories simply plug them directly into the accessory plug. To power 110V items plug a correct power invertor into the accessory plug and plug the item into the converter. To charge the power supply and control unit plug the correct power supply directly into the charger plug.

CONCLUSIONS, RAMIFICATIONS, and SCOPE

Accordingly, the reader will see that the portable overhead electric fan of this invention can be used to effectively cool a camping tent, can be used to promptly remove all excess humidity from a camping tent, and can be easily adapted to employ additional accessories such as lighting, radios, etc. In addition, this invention can be used inside a camping tent without taking up much space. Also, this invention remains effective in rainy weather or other times with the tent doors are closed.

Although the description above contains many specifications, these should not be construed as limiting the scope of the invention but merely providing illustrations of some of the presently preferred embodiments of this invention. Thus the scope of the invention should be determined by the appended claims and their legal equivalents, rather than by the examples given.

Thus the scope of the invention should be determined by the appended claims and their legal equivalents, rather than by the examples given.

What is claimed is:

1. A portable camping tent structure with a built-in overhead electric fan, comprising:

a. a dome outdoor tent structure and supporting hardware with reinforced corners adapted for use with supporting pole holders, a series of supporting poles designed to fit inside the tent, and proper holders for said supporting poles.

b. an overhead electric fan and light supported by said poles, c. and a portable power source with built-in charger and accessory hookups, and switches for selectable fan speeds, fan direction, and light power control whereby said electric fan and light unit will be supported by said poles and holders and fitted into the interior of said camping tent and powered by said portable power source.

* * * * *